United States Patent [19]

Arft

[11] Patent Number: 5,075,909

[45] Date of Patent: Dec. 31, 1991

[54] ANTI-TILT SOFA SLEEPER MECHANISM

[75] Inventor: Dennis Arft, Joplin, Mo.

[73] Assignee: Legett & Platt, Incorporated, Carthage, Mo.

[21] Appl. No.: 690,604

[22] Filed: Apr. 24, 1991

[51] Int. Cl.[5] ..... A47C 17/22

[52] U.S. Cl. ..... 5/13; 5/31

[58] Field of Search ..... 5/13, 28, 29, 31, 32.1, 5/33, 34, 57.2

[56] References Cited

U.S. PATENT DOCUMENTS

| | | | |
|---|---|---|---|
| 2,803,019 | 8/1957 | Fox | 5/13 |
| 3,284,812 | 11/1966 | Koch | 5/13 |
| 3,292,188 | 12/1966 | Gerth | 5/13 |
| 4,800,598 | 1/1989 | Arft | 5/13 |
| 4,918,770 | 4/1990 | Hartline et al. | 5/13 |

*Primary Examiner*—Michael F. Trettel

*Attorney, Agent, or Firm*—Wood, Herron & Evans

[57] ABSTRACT

A foldable sofa sleeper mechanism having pivotally interconnected head, body, intermediate, and foot sections movable between a folded position in which the mechanism is contained within a storage enclosure of a sofa frame, and an extended unfolded position in which the bed frame extends in a planar attitude away from the sofa frame, and tilt prevention means for preventing the head end of the unfolded sofa sleeper mechanism from tilting downwardly when an excessive weight is placed thereon, which tilt prevention means includes at least one anti-tilt link and at least one anti-tilt lever, wherein one end of the link is connected to the mechanism at one location and the other end of the link is connected to one end of the lever, with the lever being pivotally connected to the mechanism at another location. When the mechanism is unfolded the other end of the lever blocks downward rotation of the head section; as the mechanism is folded the lever is rotated so as to allow downward rotation of the head section so that the mechanism may be collapsed within the sofa frame.

10 Claims, 2 Drawing Sheets

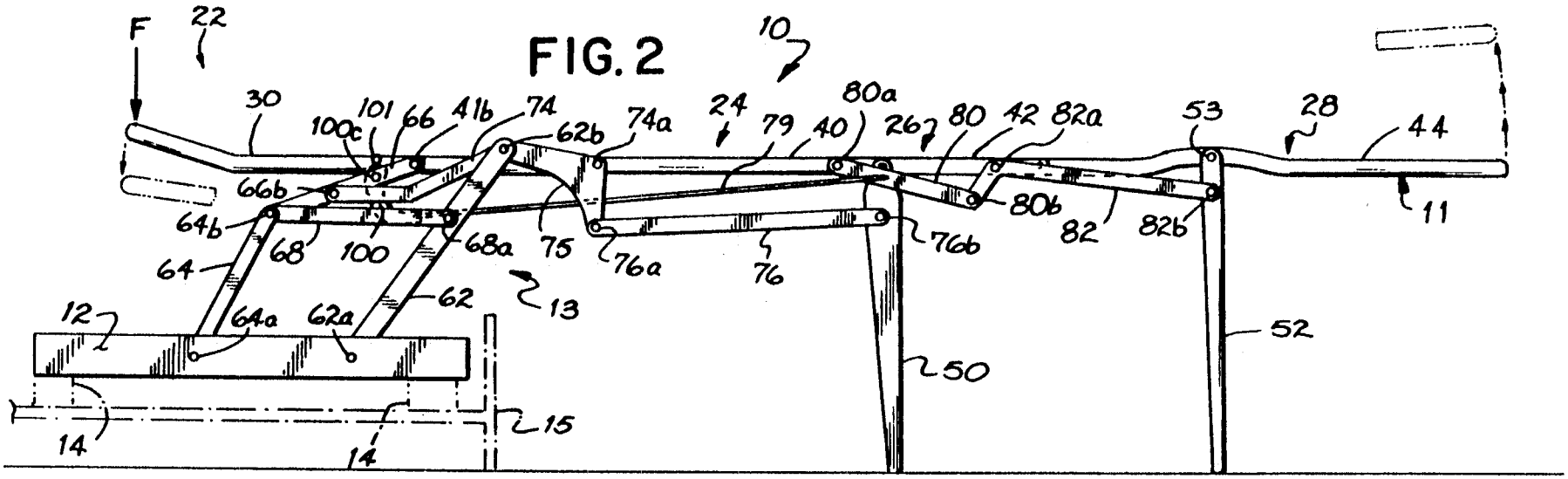
FIG. 2
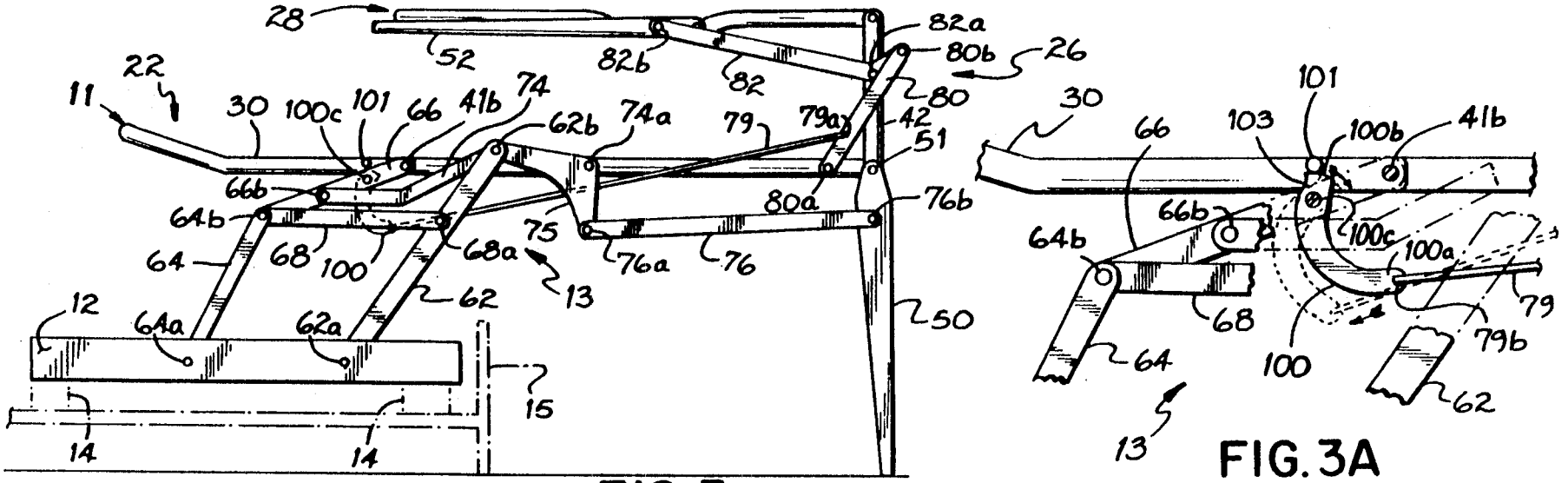
FIG. 3A
FIG. 3

ANTI-TILT SOFA SLEEPER MECHANISM

BACKGROUND OF THE INVENTION

This invention relates to a sofa sleeper and, more particularly, to a sofa sleeper of the type which includes a foldable bed having head, body, intermediate and foot sections which are foldable and which may be collapsed and hidden in the bottom of the sofa frame when the sofa sleeper is used as a seating surface.

Sofa sleeper mechanisms generally comprise a four-section foldable bed frame including pivotally interconnected head, body, intermediate and foot sections which are adapted to be moved between a fully folded or retracted position contained within a box-like sofa frame, and an extended position wherein the sections extend out and over the front rail of the sofa frame to form an extended flat bed. The head, body, intermediate and foot sections of the bed frame each include a pair of opposed side frame members, usually in the form of angles or tubes, which are pivotally connected at their ends so that the sections are foldable or collapsible upon one another. The side frame members support a link or cloth fabric over which a mattress is placed. The bed frame is supported when in the extended bed position by linkage mechanisms at the head end and by a plurality of foldable legs at the center and foot end of the frame.

A common problem characteristic of sofa sleepers is that when folded out into the flat bed sleeping position, they are subject to tilting about the linkage mechanism which supports the foldable bed frame from the wooden sofa frame. Such tilting occurs when excessive weight is applied to the head section of the sofa sleeper. In that event, the foot end of the sofa sleeper tips up in the air, and the head end tips downwardly. This phenomena commonly occurs whenever one or more persons sit on the head end of the unfolded sofa-sleeper mechanism, as for example, to watch TV, or if a person stands on the head end of the unfolded bed, as for example, to adjust curtains behind the bed. In either event, the head end of the unfolded sleeper mechanism drops down while the foot end lifts upwardly, thereby dropping the person whose weight is causing the mechanism to tilt down into the cavity of the wooden sofa frame. Manifestly, such tilting is undesirable.

There have been sofa sleeper mechanisms which included a locking mechanism for preventing tilting of the sofa-sleeper mechanism when in the unfolded condition. Such prior art mechanisms are characterized by multiple link locking mechanisms, as for example, the anti-tilt locking mechanism disclosed in Gerth U.S. Pat. No. 3,292,188. The difficulty with such anti-tilt locking mechanisms is that they all require complex multiple links or linkage elements to effect the lock and are all subject to criticism because of the added expense those multiple link locking mechanisms add to the sofa-sleeper mechanism. They are also subject to failure in the event that the linkages bend or the pivots about which the multiple links are mounted become worn or broken.

Another prior art means for preventing tilting of a sofa sleeper mechanism is disclosed in Arft U.S. Pat. No. 4,800,598. In Arft '598 the tilt prevention means includes at least one flexible, non-stretchable cable fixedly connected to two locations on the sofa sleeper mechanism.

It has therefore been an objective of this invention to provide an improved anti-tilt sofa-sleeper mechanism which utilizes a less complex linkage and which is much less expensive to add to a sofa-sleeper mechanism than the multiple link locking mechanisms of the prior art.

This objective is accomplished and this invention is predicated upon the concept of connecting a pivoted anti-tilt lever to an anti-tilt link, wherein the lever and link are connected between two locations on the mechanism such that the lever prevents the unfolded mechanism from tilting to drop the head end of the unfolded mechanism.

SUMMARY OF THE INVENTION

According to the practice of this invention, a foldable sofa-sleeper mechanism is mounted upon a sofa frame in such a manner that it may be stored within a storage enclosure of the sofa frame. The mechanism includes a bed frame having pivotally interconnected head, body, intermediate and foot sections, as well as a mattress supporting fabric extended between opposed side rails of the sections. This mechanism includes a pair of center legs connected to a center actuating arm operable to retract the center legs beneath the body section of the frame when the mechanism is folded into the sofa frame and to extend the center legs into an unfolded vertical orientation beneath the center section of the bed frame when the bed frame is extended into a horizontal flat orientation. A rigid anti-tilt rod or link is connected on one end to the mechanism at one location and is connected on its other end to one end of an anti-tilt lever. The anti-tilt lever is pivotally connected to the mechanism at another location. The connection is such that the anti-tilt prevents the mechanism from tilting in response to a downward force upon the head end of the sofa-sleeper mechanism when the bed is unfolded. In the preferred practice of this invention the bed frame is partially and pivotally supported from the sofa frame upon an upper support link; the anti-tilt rod is connected to a compression lock link of the mechanism, and the anti-tilt lever is pivotally connected to the upper support link. The pivoted end of the lever blocks a pin on the head section of the mechanism when the mechanism is unfolded, thereby preventing the head section from rotating about its pivoted connection to the upper support link.

The primary advantage of this anti-tilt sofa-sleeper mechanism is that it provides an anti-tilt feature which may be relatively inexpensively added to any conventional foldable sofa-sleeper mechanism. It also is advantageous because it enables the sofa-sleeper mechanism to be secured against tilting movement with a relatively inexpensive anti-tilt mechanism.

These and other objects and advantages of this invention will be more readily apparent from the following description of the drawings in which:

FIG. 2 is a side elevational view of the mechanism of FIG. 1, illustrating in phantom the manner in which the mechanism could be tilted in the absence of the anti-tilt feature of this invention.

FIG. 3 is a side elevational view of the mechanism of FIG. 1, but in the partially folded condition of the mechanism.

FIG. 3A is a fragmentary side elevational view (partially broken away) of the anti-tilt link and lever of FIG. 1, illustrating in phantom the rotation of the lever.

Figure 1:
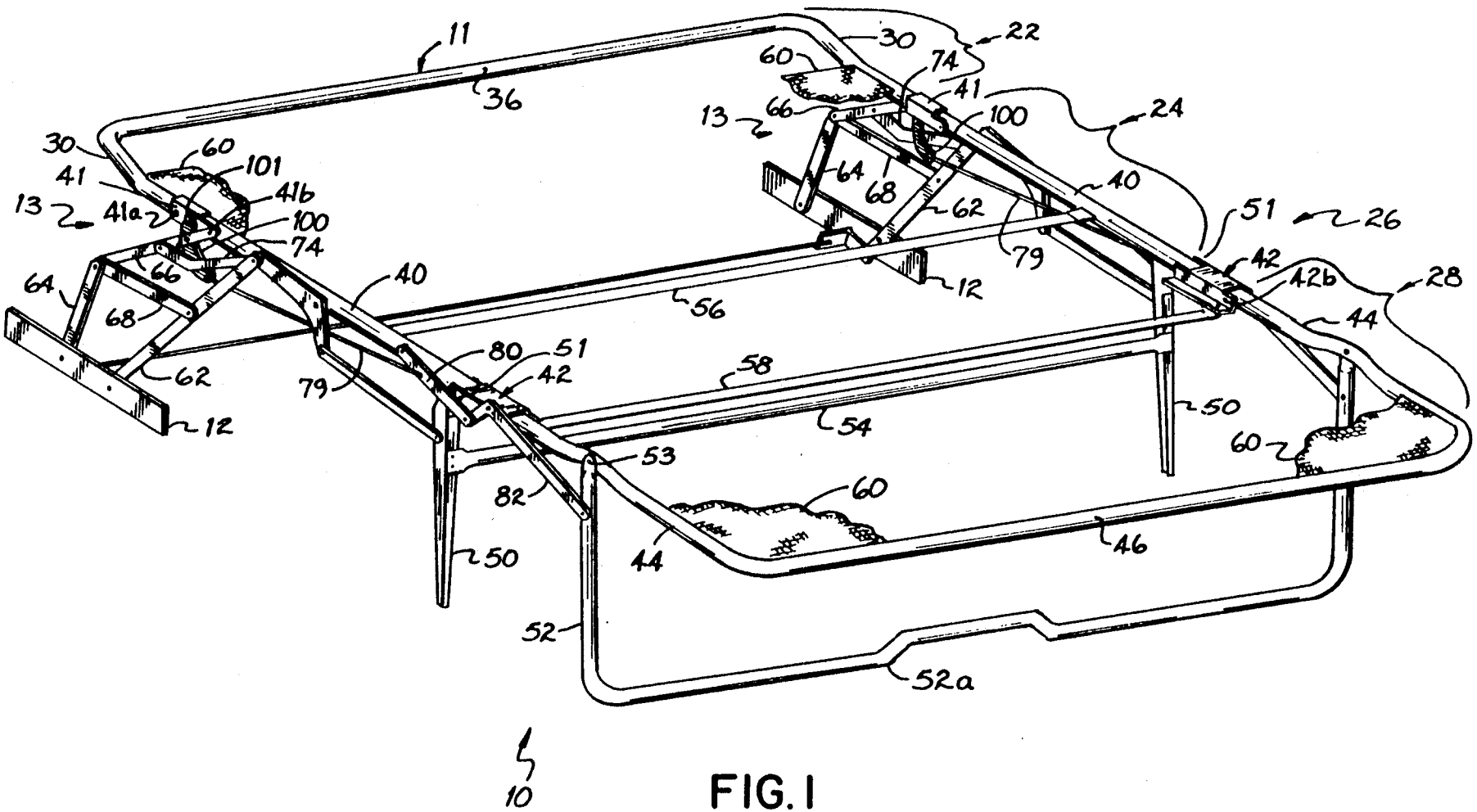
FIG. 1 is a perspective view of an unfolded sofa-sleeper mechanism incorporating the invention of this application.

Referring now to the drawings, it will be noted that the sofa-sleeper mechanism 10 is supported from a pair of mounting plates 12 which are fixedly secured to an upholstered sofa frame, indicated generally by the numeral 14 (FIGS. 2 and 3). The upholstered sofa frame conventionally has a backrest cushion (not shown), a pair of side rails (not shown) and a fixed front rail 15 which define a generally rectangular storage enclosure for the folded mechanism 10. The sofa frame 14 per se does not form any part of the invention of this application and may comprise any standard upholstered frame.

The foldable sofa-sleeper mechanism 10 comprises a bed frame 11 and a linkage mechanism 13 for supporting that frame 11 from the mounting plates 12. The bed frame 11 comprises a rear head section 22, a long body section 24 pivotally connected at one end to the head section 22, a short intermediate section 26 pivotally connected at one end to the other end of the body section 24, and a foot section 28 pivotally connected to the other end of the short intermediate section 26. The head section 22 comprises symmetrically disposed left and right side members 30. In the illustrated embodiment, these side members are tubular in configuration and are interconnected by a cross member 36 which comprises a transverse tubular section of the side members 30.

The body section 24, the short intermediate section 26, and the foot section 28 each comprises symmetrically disposed left and right side members 40, 42 and 44, respectively. The body section side frame members 40 and the foot section side frame members 44 are tubular in configuration, while the intermediate frame section 42 is channel shaped. A transverse cross member 46 connects the forward ends of the foot section side members 44. In the preferred embodiment, the foot section side members 44 and the transverse cross member 46 are bent from a single unitary tube.

The interconnected bed frame sections 22, 24, 26 and 28 are supported in their extended position by a pair of foldable center support legs 50 pivotally connected to the forward ends of the body section side members 40 by rivets 51. A generally U-shaped foot section support leg 52 is pivotally connected at its upper ends by rivets 53 to the foot section side members 44. A tubular cross member 54 interconnects the center legs 50 and is riveted thereto to provide the legs 50 with lateral stability.

A cross brace 56 extends between the opposite side members 40 of the body section 24. A similar cross brace 58 extends between the side members 42 of the intermediate section 26 of the mechanism. The opposite ends of each of these cross braces 56, 58 is fixedly attached to the side members of the body section and intermediate section of the mechanism, respectively, so as to provide lateral stability to the bed frame.

Stretched between the side frame members of the head, body, intermediate and foot sections of the frame is a fabric 60 for supporting a mattress atop the mechanism. The fabric 60 may be a wire link fabric or a cloth fabric or any other conventional mattress supporting flexible fabric material. Such fabric materials are conventional and per se form no part of the invention of this application.

The interconnected sections 22, 24, 26 and 28 together form the rectangular bed frame 11 with curved corners when the mechanism 10 is fully pulled out. As may be seen in FIGS. 1 and 2, the sections lie in coplanar relationship, i.e., they all lie on the same horizontal plane and provide a resilient planar surface for supporting a mattress (not shown).

The foldable frames on both sides of the bed are similar and are symmetrically disposed. Since the means which connect the longitudinal portions of the bed frame on the right and left facing sides of the bed are similar and symmetrically disposed, only the connections on one side have been illustrated and will be described herein. The side of the frame shown in FIGS. 2 and 3 is the left facing side of the bed which is the side on the left side of a person standing in front of the foot end of the bed and looking toward the head end of the bed.

The side members 30 of the head section 22 are connected to the rearward end of the side members 40 of the body section by a rear support channel 41. This channel is pivotally connected to the member 30 by a rivet **41*a* and is connected to the rearward end of the side members 40 of the body section by a rivet 41*b*. These rivet connections enable the channel 41 to pivot relative to the side members 40 of the body section and enable the side members 30** of the head section to pivot relative to the channel.

Similarly, the forward end of the side members 40 of the body section are pivotally connected to the intermediate frame section members 42 by a pivot 51. At the forward end, the intermediate frame section members 42 are pivotally connected by a rivet **42*b* to the rearward end of the side members 44 of the foot section 26 of the mechanism. The side members 42** are both channel shaped in configuration so as to enable the top surfaces of the channels to function as stops for maintaining the side members in a horizontal plane when the frame is unfolded.

Referring now to FIGS. 1–3, it will be seen that the sofa-sleeper mechanism 10 is supported upon the sofa frame by a series of links supported from the mounting plate 12. This mounting plate is secured to the sofa frame 14 by conventional screws or fasteners (not shown). Pivotally mounted upon this mounting plate is a pilot arm 62, the lower end of which is pivotally connected to the mounting plate 12 by a rivet **62*a* and the upper end of which is pivotally connected to an actuating link 74 by a rivet 62*b*. A pair of interconnected lower and upper rear support links 64, 66, respectively, interconnect the side members of the body supporting section of the frame to the mounting plate 12. The lowermost one 64 of these links is pivotally attached to the mounting plate 12 by a rivet 64*a*, and the upper end of the uppermost one 66 of these supporting links is pivotally secured to the rear of the side member of the body supporting section 24 of the frame by a rivet 41*b*. The two links 64, 66 are interconnected at their upper and lower ends, respectively, by a rivet 64*b*. The pilot arm 62 and the lower rear support link 64 are interconnected by a control link 68 which is pivotally connected to each link by a rivet 68*a* and 64*b***, respectively.

The actuating link 74 interconnects the upper rear support link 66 and the side member 40 of the body supporting section 24 of the mechanism. This actuating link is pivotally connected to the upper rear supporting link 66 by a rivet **66*b* and is connected to the side member 40 of the body supporting section 24 of the mechanism by a rivet 62*b***.

An actuating plate 75 extends forwardly from its pivotal connection **62*b* with the upper end of the pilot arm 62 to the pivotal connection via the rivet 74*a* with the side member 40 of the body section of the bed frame 11 to a rivet connector 76*a* with a center leg actuating arm 76. At its forward end, the actuating arm 76 is pivotally connected to the center leg 50 via a rivet 76***b*. As is conventional in such foldable sofa sleeper mechanisms, the actuating link 74 and plate 75 cooperate with the actuating arm 76 to effect inward folding of the leg 50 about its pivotal connection 51 against the side member 40 of the body section of the frame when the mechanism is collapsed during folding into the sofa frame 14.

In order to actuate the front leg 50 so as to cause it to move upwardly to position the transverse leg tube 52*a* in juxtaposition to the transverse tube 46 of the foot section of the frame, a pair of links, a compression lock link 80, and a leg lock link 82, interconnect the upper end of the front leg 52 with the side member 40 of the body section of the frame and with the side member 42 of the intermediate section of the frame, respectively.

The compression lock link 80 is pivotally connected to the side member 40 by a rivet 80*a* and is pivotally connected to the rearward end of the leg lock link 82 via a rivet 80*b*. The leg lock link 82 is pivotally connected via a rivet 82*a* to the side members 42 of the intermediate section 24 of the frame and is connected at its forward end to the leg 52 via a rivet 82*b*. This connection of the front leg 52 to the side members of the frame 44 is also conventional and is operative to collapse the front leg 52 of the frame into juxtaposition with the foot section of the mechanism 46 when the mechanism 10 is collapsed preparatory to being folded into the sofa sleeper frame 14.

MECHANISM OPERATION

Folding of the mechanism into the cavity of the sofa frame 14 from the flat bed position illustrated in FIGS. 1 and 2 to the collapsed position (not shown) of the sofa mechanism within the storage enclosure of the sofa sleeper frame 14 is accomplished in the conventional manner and has therefore not been illustrated and described in detail herein. It is illustrated and described in a very similar sofa-sleeper mechanism in U.S. Pat. No. 4,571,755 assigned to the assignee of this application. It is also illustrated and described in numerous other sofa sleeper patents having similar sofa-sleeper mechanism linkages for collapsing and folding a mattress supported by the mechanism into and locating that mechanism and mattress within the storage cavity of a sofa sleeper.

Basically, the mechanism is folded from the flat bed position illustrated in FIGS. 1 and 2 into the collapsed sofa position by first lifting the front tubular cross member 46 of the foot section of the mechanism until that foot section is located in a vertical plane. As a consequence of this movement, the front leg 52 is caused by the leg lock link 82 and the compression lock link 80 to be folded into juxtaposition with the side members of the foot section 28 of the mechanism.

Continued pushing against the now vertically oriented leg cross tube 52*a* and foot section cross member 46 causes the mechanism to pivot about the pivot point or rivet 51 connecting the intermediate frame section 26 to the body section 24, thereby lifting the intermediate frame section 26 into a vertical position and simultaneously positioning the foot section 28 of the mechanism in a horizontal plane overlying the body section 24.

Continued folding movement of the mechanism is then effected by lifting the cross tie member 58 upwardly so as to lift what is now the front of the partially folded mechanism, including the center leg 50, upwardly. This upward movement of the folded foot and intermediate sections of the frame causes the actuating link 74 and actuating arm 76 to collapse the center legs 50 beneath the body section 24 of the frame. Continued lifting of the front section of the folded leg and intermediate sections of the frame causes the rear end of the body section of the mechanism to be lowered and moved rearwardly. Simultaneously, the head section 22 is moved into an inclined position with respect to the body section 24 preparatory to the head section of the frame being moved up into the cavity in the backrest section of the sofa frame. On further movement of the folded frame, the head section continues to rotate until the head section is perpendicular to the body section and the body section is located in a horizontal plane internally of the enclosure of the sofa frame.

The mechanism 10 described hereinabove and the manner in which it is folded into the enclosure of the sofa frame 14 and unfolded therefrom into the flat bed position illustrated in FIGS. 1 and 2 is conventional and per se forms no part of the invention of this application. In fact, other conventional mechanisms could as well be utilized in the practice of this invention.

ANTI-TILT MECHANISM

With reference to FIG. 2 there is illustrated in phantom lines the manner in which the complete unfolded horizontal bed frame may be tilted downwardly at the head end and upwardly at the foot end when a very large force F is applied to the head end of the unfolded mechanism. As there illustrated and in the absence of the anti-tilt mechanism of this invention, the horizontal bed frame 11 of the mechanism 10 may all pivot about the pivot connection or rivet 62*b* of the pilot arm to the actuating link 74 so as to cause the head end of the mechanism to drop downwardly, and the foot end to lift upwardly. Such a force F can be applied to the head end of the mechanism when it is in an unfolded condition when one or more persons sit on the head end to watch TV or stand on the head end to reach curtains behind the head end of the mechanism or otherwise apply a very heavy force F To the head end. Upon such tilting, the person applying the force F is caused to drop downwardly into the storage enclosure of the sofa frame.

Referring now to FIGS. 2–3A, to prevent such tilting of the unfolded mechanism, the mechanism of this invention includes a rigid anti-tilt rod or link 79 pivotally connected at one end 79*a* to the compression lock link 80 and pivotally connected at the other end 79*b* to one end 100*a* of an anti-tilt lever 100, the lever 100 being pivotally connected to the upper support link 66 by a pivot 100*c*. The pivot 100*c* is located intermediate of the ends 100*a*, 100*b* of the anti-tilt lever 100.

When the bed is unfolded, as illustrated in FIGS. 1 and 2, the rod 79 is caused to pull the lever 100 toward the foot of the bed, thereby rotating the lever counterclockwise about the pivot 100*c* into a position to prevent the unfolded mechanism from tilting when a force F is applied to the head end of the mechanism. The reason that the mechanism cannot be tilted downwardly is because a pin or stud 101 which extends outwardly from the side member 30 of the head section 22 is blocked by the upper end 100*b* of the lever 100 from downward movement, thereby preventing the head section 22 from rotating downwardly about the abovementioned pivot 62*b*. And, when the mechanism is folded (FIGS. 3 and 3A), the rod 79 is moved toward the head of the bed, causing the rod to push lever 100 clockwise about the pivot 100*c*. In doing so, the end 100*b* of the lever 100 is rotated out of an interfering position with the pin 101. A detent or cutaway 103 in the lever 100 is thereby positioned beneath the pin 101, such that the head section 22 is free to rotate downwardly about pivot 41*b* and to collapse within the sofa frame.

As will now be readily apparent, the provision of an anti-tilt rod 79 and lever 100 secured to one side, or two wires and levers, each secured to one of the two sides of the mechanism, ensures that the head end of the unfolded mechanism cannot be tilted downwardly when a force is applied to the head end of the unfolded mechanism. This rod 79 and lever 100 mechanism is relatively inexpensive and has the advantage of being easily added to any sofa-sleeper mechanism so as to give to that mechanism an anti-tilt feature.

While I have described only a single preferred embodiment of my invention, persons skilled in this art will appreciate other changes and modifications which may be made without departing from the spirit of my invention. Therefore, I do not intend to be limited except by the scope of the following appended claims.

What is claimed is:

1. A foldable sofa-sleeper mechanism adapted to be mounted upon a sofa frame and stored within a storage enclosure of said sofa frame, said mechanism comprising:

a bed frame having pivotally interconnected head, body, intermediate and foot sections each having a pair of opposed side rails, a mattress supporting fabric extending between said sections and connected thereto, a pair of center legs connected to a center actuating leg means operable to retract and extend said center legs, said mechanism being movable between a folded position in which said mechanism is contained within said storage enclosure of said sofa frame and said center legs are retracted, and an extended unfolded position in which said bed frame extends forwardly from said sofa frame and said center legs extend downwardly from said bed frame; the improvement comprising:

tilt prevention means for preventing downward tilting of said head section of said unfolded sofa-sleeper mechanism, said tilt prevention means including a stop fixedly attached to said head section of said bed frame, at least one rigid anti-tilt link having first and seconds ends and at least one anti-tilt lever having first and second ends, wherein said first end of said anti-tilt link is connected to said mechanism at one location and said second end of said anti-tilt link is connected to said first end of said lever, and wherein said lever is pivotally connected intermediate its ends to said mechanism at another location, said anti-tilt link being operable to rotate said lever to a first position which blocks rotation of said head section by engagement of said stop with said second end of said lever when said mechanism is unfolded, and said anti-tilt link being operable to rotate said lever to a second position wherein said head section becomes rotatable relative to said lever as said mechanism is folded.

2. The sofa sleeper mechanism of claim 1 wherein said anti-tilt link is a rigid rod.

3. The sofa sleeper mechanism of claim 1 wherein each of said body section rails are at least partially supported from an upper support link, and said lever is pivotally connected to said upper support link.

4. The sofa sleeper mechanism of claim 1 wherein said first end of said anti-tilt link is connected to a movable element of said bed frame.

5. The sofa sleeper mechanism of claim 1 wherein said first end of said anti-tilt link is connected to a compression lock link of said mechanism.

6. A foldable sofa sleeper mechanism adapted to be mounted upon a sofa frame and stored within a storage enclosure of said sofa frame, said mechanism comprising:

a bed frame having pivotally interconnected head, body, intermediate and foot sections, said mechanism being movable between a folded position in which said mechanism is contained within said storage enclosure of said sofa frame and an extended unfolded position in which said bed frame extends forwardly in a generally planar attitude from said sofa frame, the improvement comprising:

tilt prevention means for preventing downward tilting of said head section of said unfolded sofa sleeper mechanism, said tilt prevention means including a stop fixedly attached to said head section of said bed frame, at least one rigid anti-tilt link having first and second ends and at least one anti-tilt lever having first and second ends, wherein said first end of said anti-tilt link is connected to said mechanism at one location and said second end of said anti-tilt link is connected to said first end of said lever, and wherein said lever is pivotally connected intermediate its ends to said mechanism, whereby said lever is positioned by said anti-tilt link in a blocking position relative to said stop when said mechanism is unfolded and is moved to a non-blocking position relative to said stop when said mechanism is folded.

7. The sofa sleeper mechanism of claim 6 wherein said anti-tilt link is a rigid rod.

8. The sofa sleeper mechanism of claim 6 wherein said body section is at least partially supported by at least one upper support link.

9. The sofa sleeper mechanism of claim 6 wherein said first end of said anti-tilt link is connected to a movable element of said bed frame.

10. The sofa sleeper mechanism of claim 6 wherein said first end of said anti-tilt link is connected to a compression lock link of said mechanism.

* * * * *